US005321414A

United States Patent [19]

Alden et al.

[11] Patent Number: 5,321,414

[45] Date of Patent: Jun. 14, 1994

[54] DUAL POLARIZATION DIPOLE ARRAY ANTENNA

[75] Inventors: Adrian W. Alden, Ottawa; Tom T. Ohno, Carp, both of Canada

[73] Assignee: Her Majesty in right of Canada as represented by the Minister of Communications, Canada

[21] Appl. No.: 109,979

[22] Filed: Aug. 20, 1993

Related U.S. Application Data

[63] Continuation of Ser. No. 658,978, Feb. 21, 1991, abandoned.

[30] Foreign Application Priority Data

Mar. 1, 1990 [CA] Canada ..... 2011298

[51] Int. Cl.[5] ..... H01Q 21/12

[52] U.S. Cl. ..... 343/816; 343/814; 343/815

[58] Field of Search ..... 343/816, 754, 795, 802, 343/812, 813, 814, 815, 825, 826, 827, 700 MS

[56] References Cited

U.S. PATENT DOCUMENTS

| | | | |
|---|---|---|---|
| 3,887,925 | 6/1975 | Ranghelli et al. | 343/795 |
| 4,079,268 | 3/1978 | Fletcher et al. | 343/700 MS |
| 4,131,896 | 12/1978 | Miller | 343/815 |
| 4,943,811 | 7/1990 | Alden et al. | 343/814 |
| 5,039,994 | 8/1991 | Wash et al. | 343/813 |

*Primary Examiner*—Donald Hajec
*Assistant Examiner*—Tan Ho
*Attorney, Agent, or Firm*—Laff, Whitesel, Conte & Saret

[57] ABSTRACT

A dual polarized dipole array antenna for high efficiency power reception or transmission of electromagnetic waves comprises an array of dipole antenna elements and connecting transmission lines, all highly symmetrically arranged each other on a dielectric layer. Rectifiers and wave filters are added to the transmission lines to produce rectified outputs of each dipole antenna element.

5 Claims, 2 Drawing Sheets

DUAL POLARIZATION DIPOLE ARRAY ANTENNA

This application is a continuation of application Ser. No. 07/658,978, filed Feb. 21, 1991, now abandoned.

FIELD OF THE INVENTION

The present invention relates to antennas for transmitting or receiving electromagnetic waves and, more specifically, is directed to dipole array antennas having a plurality of antenna units symmetrically arranged for improved performances.

BACKGROUND OF THE INVENTION

Microwave antennas are widely used in communications, radio astronomy, radiotelemetry, radars, etc. It has also been widely proposed and experimented to use electromagnetic waves for energy transmission between two separated locations without use of physical connections. There is a need for a cost-effective means for the reception and conversion of electromagnetic power to direct current power more suitable for moving platforms on which the reception/conversion system is located. A rectifying antenna is customarily called a rectenna and includes antenna elements and rectifiers directly connected to them to produce a direct current output. An exemplary application of the rectenna in which this need arises is the provisioning of 30 KW or more of propulsive and communications payload power for lightweight electrically-powered aircraft. In operation, such aircraft would circle over fixed ground antenna systems, transmitting power in the 2.4 to 2.5 GHz microwave ISM band, for continuous periods of weeks or months at a time and relay communication signals between separated locations.

Of course, there are many other applications in which the supply of energy to a remotely located station is desired in the form of electromagnetic waves, thus eliminating the needs of physical connections, e.g. wires, pipes, and permitting the station to be movable. It is also advantageous to provide antennas which can perform equally well for microwaves of various polarizations.

Another application for antenna arrays at microwave and higher frequencies is their use in imaging arrays where information regarding the electromagnetic power incident on each discrete element of an array is desirable.

Copending U.S. patent application Ser. No. 07/124,159 filed on Nov. 23, 1987, now U.S. Pat. No. 4,943,811 (corresponding Canadian patent application No. 557,680 filed on Sep. 16, 1988) which has the present inventors as joint inventors, describes a dual polarization power reception and conversion system. This device consists of two orthogonal arrays of linearly-polarized thin film rectennas of specific format and element spacings. This antenna has proven to be highly efficient and to have a wide range of angles of reception. However, it has certain drawbacks in its manufacture, accessibility for testing and repair and power handling capability.

This prior-art system consists of two dielectric layers, each metal clad on both sides, in close proximity to each other (though electrically isolated). This requires a multilayer printed circuit board construction with its attendant difficulties and cost. In addition the thickness of the diode rectifiers used and the requirement for access to them involves the partial cutting away of one dielectric layer, a difficult procedure with thin flexible layers used.

Thirdly, the power handling capability of this prior art system is limited to one rectification unit for each polarization with power dissipation limited to radiative and convective cooling of the exposed foreplanes only. Power handling is also limited by the requirement of antenna spacings of at least half a wavelength (in free space). This element density limitation is due to the requirements for resonant half wave dipoles and isolation between the output filter of one element and the antenna of the adjacent unit.

Applicant's Canadian patent application No. 587,182 (filed on Dec. 28, 1988) describes an alternative power reception and conversion system. This design eliminates the manufacturing, installation and power handling problems discussed above but again is limited in its power handling by the requirement that the patch antennas be of resonant size (approximately half wavelength in the dielectric used). This criterion limits the number of elements that can be accommodated in any given area and hence the power handling capability of the array. There are a few references of interest. Thus "New Techniques for Combining Solid State Circuits" by Staiman in IEEE Journal Solid State Circuits, Vol. SC-3, Sept. 1968, pp 238–243, discusses separately spaced dipole antenna and "Field Theory of Guided Waves" by Collin, McGraw-Hill, New York, 1960, p 271, analyzes antenna reactances in small array antennas.

SUMMARY OF THE INVENTION

As will be discussed in detail below, the aforementioned deficiencies of the prior art rectennas and antennas are significantly reduced with the present invention. Briefly stated, the present invention is a dual polarized dipole array antenna for power reception or transmission of electromagnetic waves. The antenna has a plurality of symmetrically arranged substantially identical antenna units. Each antenna unit comprises a dipole antenna element and has two identical feedlines symmetrically attached to the dipole element. Each feedline has identical wave filters and a terminal for an antenna feed or load. The antenna units are located on a single dielectric layer, with dipole antenna element and transmission lines connected symmetrically in two directions such as to enable dual polarization power reception or transmission, dc power removal and high power handling. A reflector plane is also provided on the other side of the dielectric layer at a predetermined distance from the antenna units.

OBJECTS OF THE INVENTION

It is an object of the present invention to provide a dipole array antenna which is easy to manufacture.

It is a further object of the present invention to provide a dipole array antenna with better power handling capability characteristics.

It is yet another object of the present invention to provide a dipole array antenna characterized by a wide range of reception angles to allow relative movement between the reception and the transmission systems.

BRIEF DESCRIPTION OF THE DRAWINGS

Other objects, features and advantages of the present invention will be apparent from the following description taken in connection with the accompanying drawings, wherein.

DETAILED DESCRIPTION OF PREFERRED EMBODIMENTS

It should be noted that while the following description deals mainly with the square dipole antenna element in a square array, it should be evident to those skilled in the art to visualize and construct array antennas which have a high degree of symmetry but not in a square format.

Figure 1:
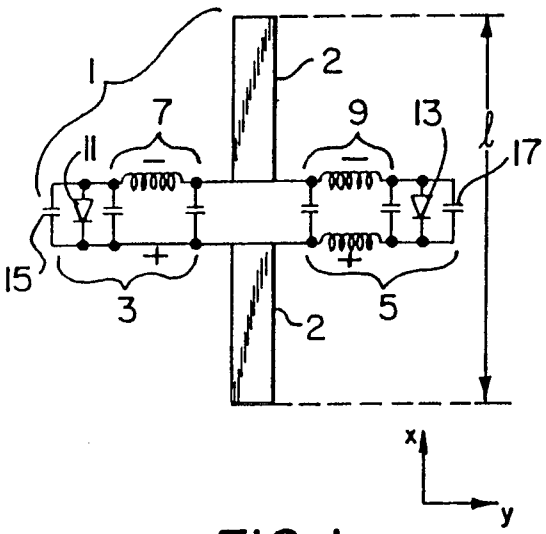
FIG. 1 is a plan view of the present invention of an antenna unit having two identical feedlines connected to the terminals of a dipole antenna element.

FIG. 1 illustrates a single antenna unit 1 according to the present invention which is positioned to intercept a portion of an electromagnetic beam transmitted in a direction z perpendicular to the plane (x,y) of the unit as shown in the Figure. The remote transmit antenna emits dual polarized waves, i.e. waves of two orthogonal polarizations, which could be unequal in amplitude and phase. These two orthogonal field components of the incident beam can be resolved into components aligned into each of the two directions x and y, x being parallel to the dipole element in FIG. 1, which is thus capable of selectively receiving the transmitted wavefield component oriented in the x direction. An antenna unit consists of a dipole antenna element 2 of dimension l with two identical feedlines 3 and 5 symmetrically attached to the dipole element, l being substantially the wavelength $\lambda/(2 \text{ or } 4 \text{ or} \ldots)$. Each of these feedlines includes filters 7 and 9 and a diode rectifier 11 and 13. FIG. 1 also shows the polarity of the dc voltage developed across the transmission lines and bypass capacitors 15 and 17.

Figure 2:
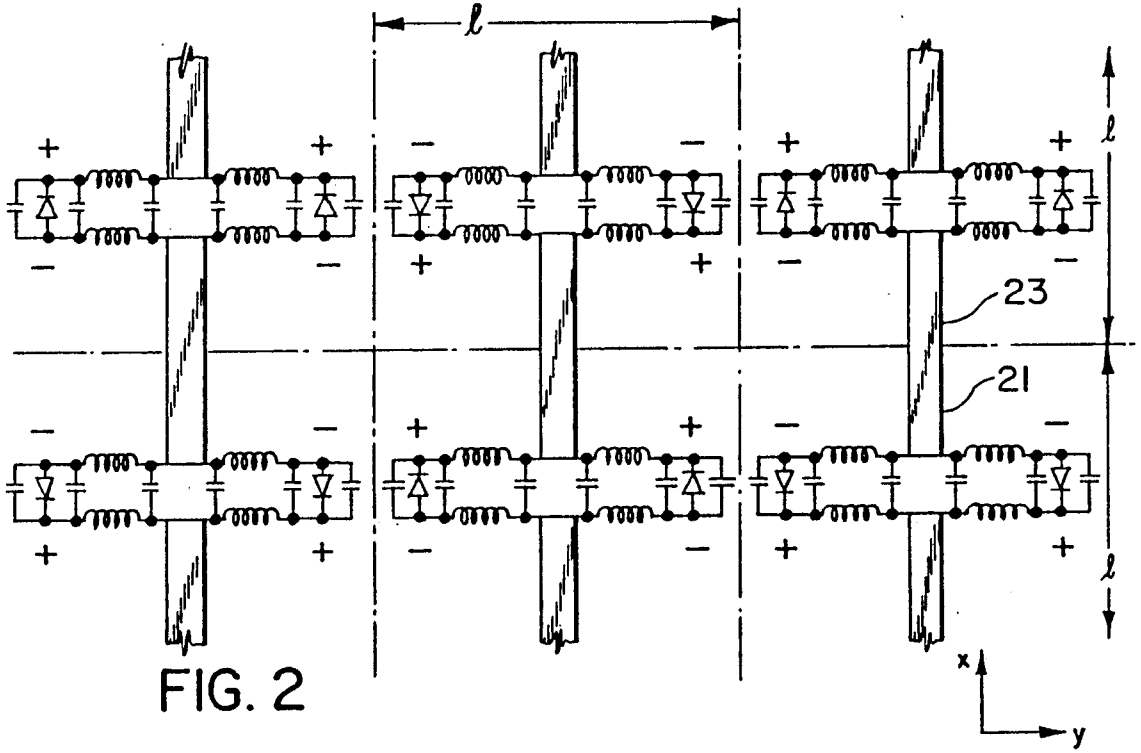
FIG. 2 is a plan view of a portion of a sub-array of the antenna showing six symmetrically arranged antenna units oriented in the x-direction to collect one polarization of the wave.

FIG. 2 shows a plan view of a portion of a subarray of the antenna consisting of an array of six antenna units of FIG. 1. It is noted that the colinear (x-direction) dipoles are contiguous, with no gap between adjacent dipole elements, e.g. 21 and 23. This construction allows the reduction of the antenna unit dimension l to values small compared to a wavelength without the large increase in antenna reactance found with separately spaced dipoles with small dimension which is described in the aforementioned article by Staiman. This concomitant increase in antenna reactance with decrease in dimension prevents the use of separate dipole rectennas at high packing densities, since this large reactance cannot be tuned out by the unit cell transmission line reflector termination, as is the case for small antenna reactances as analyzed in the aforementioned reference by Collin.

Diode rectifiers of adjacent antenna units are connected in opposite polarity across the feedlines, as shown in FIG. 2. This feature is important as will be explained below in conjunction with FIG. 3.

Figure 3:
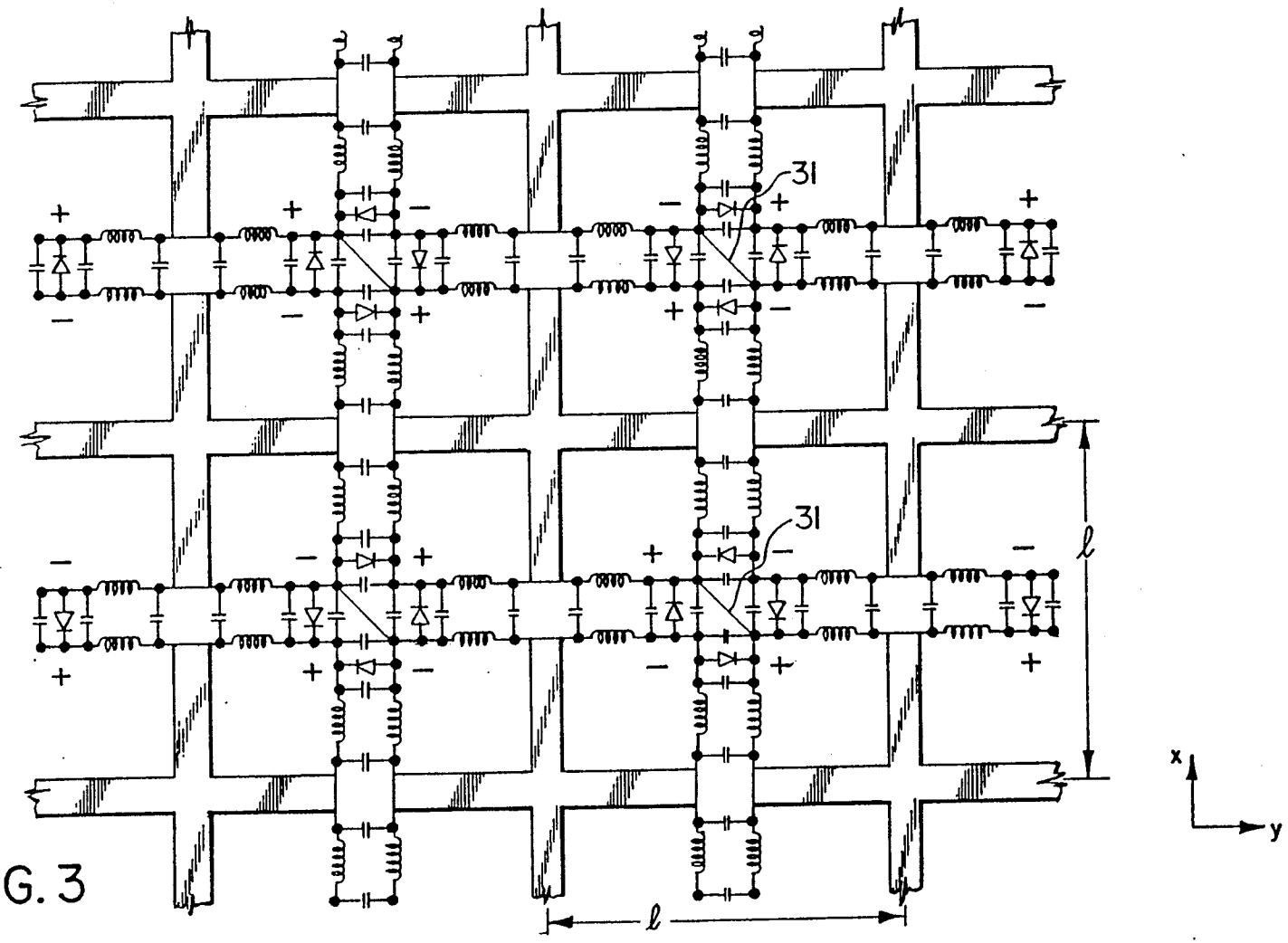
FIG. 3 is a plan view of a portion of the complete array showing interconnection between antenna elements and transmission lines.

FIG. 3 shows a plan view of a portion of the complete array with antenna units collecting the x and y polarized components of the incoming wave combined on the same plane. Unlike the antenna array taught in the aforementioned copending application No. 07/124,159, it is seen that the output filter of each rectenna unit is isolated from the next antenna element such that the $\lambda/4$ transmission line spacing between the output filter and the next dipole is not required. This allows the transmission line and network elements to be reduced to the same degree as the antenna element, resulting in high packing densities. It should also be noted that a conductive reflector plane (not shown in the Figures) is provided on the other side of the dielectric layer at a predetermined distance from the antenna units, the distance typically being substantially $\lambda/4$, but adjustable to compensate the effect of antenna reactance and the feedlines for optimum operation.

DC power collection at the edges of each antenna unit is permitted by the connection of a dc bus wire 31 diagonally across each junction of bypass capacitors, as shown in FIG. 3.

Due to the highly symmetrical nature of the antennas and transmission lines, the problem of power transmission to a large array (of the form of FIG. 3) may be replaced by a network model of a unit cell transmission line. The same treatment is described in the aforementioned copending application Ser. No. 07/124,159 for $m=0$. The problem may then be solved by standard circuit techniques. This unit cell network approach is applicable to any specified angle of beam incidence, as well as the normally incident beam and may be used to limit variations in reception efficiency when the range of beam incidence cannot be carefully limited.

Furthermore, once the dual polarization system is formulated in network terms, according to the configuration of the present invention, the effect of changes or modifications to the system may be quantified and compensated for, according to the aforementioned network model. For example, a dielectric radome may be placed directly on top of the antenna plane for system environmental protection resulting in changes in the wavelength and characteristic impedance in a small region of the cell above the antenna array.

With the configuration of FIG. 3, the dimensions of each rectenna unit may be reduced to a small fraction of a wavelength. This high packing density allows for an increase in power handling per unit area over prior art rectennas if the same high power diode rectifiers are used for each rectenna unit. Conversely, similar power handling capabilities to previous systems may be achieved with the use of low power, low cost diodes in place of the expensive high power devices necessary to achieve desirable power densities with prior art rectennas.

With all sources of power dissipation (two diodes per polarization per rectenna unit) situated on a single foreplane, heat removal is considerably improved over multilayer rectenna systems.

It is to be noted that the single plane construction of this invention is not limited to contiguous dipoles but is also applicable to the more usual case of separate dipoles.

It should also be noted that although the above treatment has considered only planar arrays, the analysis is applicable also to non-planar arrays having rotational symmetry. Examples of these surfaces are antenna arrays on all or part of the cylindrical fuselage of an aircraft or missile, and cylindrical rectenna arrays near the focus of a microwave power concentrator.

We claim:

1. A dual polarization dipole array antenna for power reception or transmission of electromagnetic waves, comprising:

a plurality of substantially identical antenna units arranged reflection symmetrically in an array in two directions, each of the said antenna units comprising a dipole element having two feedlines symmetrically attached to the dipole element, said feedlines extend in said two directions, each of said feedlines having substantially identical wave filters, and a terminal for an antenna feed or load, a dielectric layer, on one side of which the said plurality of identical antenna units are arranged symmetrically in said array by dc connecting appropriate ones of said feedlines of adjacent antenna units, and a reflector plane on the other side of the said dielectric layer and located at a predetermined distance from the antenna units.

2. The dual polarization dipole antenna according to claim 1 wherein said plurality of identical antenna units are arranged symmetrically in a square array in said two directions.

3. The dual polarization dipole array antenna according to claim 2, wherein each antenna unit has its dipole element contiguous with the dipole element of the adjacent antenna unit in said directions.

4. The dual polarization dipole array antenna according to claim 2 wherein said predetermined distance between the reflector plane and said antenna units is adjustable to compensate the effect of antenna reactance and the feedlines for optimum reception or transmission.

5. The dual polarization dipole array antenna according to claim 3 wherein said dielectric layer and reflector are curved.

* * * * *